US008727070B2

(12) United States Patent
Huber et al.

(10) Patent No.: US 8,727,070 B2
(45) Date of Patent: May 20, 2014

(54) HELMHOLTZ DAMPER AND METHOD FOR REGULATING THE RESONANCE FREQUENCY OF A HELMHOLTZ DAMPER

(75) Inventors: Andreas Huber, Baden (CH); Mirko Bothien, Zürich (CH); Nicolas Noiray, Bern (CH); Bruno Schuermans, La Tour de Peilz (CH)

(73) Assignee: Alstom Technology Ltd, Baden (CH)

( * ) Notice: Subject to any disclaimer, the term of this patent is extended or adjusted under 35 U.S.C. 154(b) by 2 days.

(21) Appl. No.: 13/158,896

(22) Filed: Jun. 13, 2011

(65) Prior Publication Data

US 2011/0308630 A1 Dec. 22, 2011

(30) Foreign Application Priority Data

Jun. 16, 2010 (EP) ..... 10166153

(51) Int. Cl.
*F01N 1/02* (2006.01)
*F01N 1/00* (2006.01)

(52) U.S. Cl.
USPC .. 181/250; 181/241; 123/184.55; 123/184.57

(58) Field of Classification Search
USPC ..... 181/250, 266, 271, 273, 276, 277, 278, 181/219, 241; 123/184.53, 184.55, 184.57
See application file for complete search history.

(56) References Cited

U.S. PATENT DOCUMENTS

| | | | | |
|---|---|---|---|---|
| 3,141,519 | A * | 7/1964 | Bottum | 181/241 |
| 3,940,721 | A * | 2/1976 | Kojima et al. | 333/233 |
| 4,539,947 | A * | 9/1985 | Sawada et al. | 123/184.57 |
| 4,546,733 | A * | 10/1985 | Fukami et al. | 123/184.57 |
| 5,377,629 | A | 1/1995 | Brackett et al. | |
| 5,475,189 | A * | 12/1995 | Field et al. | 181/241 |
| 5,930,371 | A * | 7/1999 | Cheng et al. | 381/71.5 |
| 6,508,331 | B1 * | 1/2003 | Stuart | 181/250 |
| 6,698,390 | B1 * | 3/2004 | Kostun et al. | 123/184.57 |
| 6,732,510 | B2 * | 5/2004 | Ciray | 60/312 |
| 6,915,876 | B2 * | 7/2005 | Ciray | 181/219 |
| 7,077,093 | B2 * | 7/2006 | Koelmel et al. | 123/184.57 |
| 7,337,877 | B2 * | 3/2008 | Goenka et al. | 181/250 |
| 7,757,808 | B1 * | 7/2010 | Vaz et al. | 181/250 |
| 2002/0000343 | A1 | 1/2002 | Paschereit et al. | |
| 2005/0103018 | A1 | 5/2005 | Graf et al. | |
| 2005/0199439 | A1 | 9/2005 | Goenka et al. | |
| 2005/0223707 | A1 * | 10/2005 | Ikeda et al. | 60/725 |
| 2006/0086564 | A1 * | 4/2006 | Kostun et al. | 181/250 |
| 2008/0216481 | A1 | 9/2008 | Pollarolo | |

FOREIGN PATENT DOCUMENTS

| | | | |
|---|---|---|---|
| EP | 0 111 336 | A2 | 6/1984 |
| EP | 0724684 | B1 | 11/1997 |
| EP | 0 974 788 | A1 | 1/2000 |
| EP | 1158247 | A2 | 11/2001 |
| EP | 1624251 | A1 | 2/2006 |
| WO | WO 2005/059441 | A1 | 6/2005 |

OTHER PUBLICATIONS

Extended European Search Report dated Sep. 5, 2012 issued in corresponding European Application No. 10166153.6. (7 pages).

* cited by examiner

*Primary Examiner* — Edgardo San Martin
(74) *Attorney, Agent, or Firm* — Buchanan Ingersoll & Rooney PC

(57) ABSTRACT

A Helmholtz damper, including an enclosure, a neck extending from the enclosure, and a pipe for inserting into the neck. The portions of the pipe inserted into the neck is adjusted to regulate a resonance frequency of the Helmholtz damper.

18 Claims, 3 Drawing Sheets

HELMHOLTZ DAMPER AND METHOD FOR REGULATING THE RESONANCE FREQUENCY OF A HELMHOLTZ DAMPER

RELATED APPLICATION

This application claims priority under 35 U.S.C. §119 to European Patent Application No. 10166153.6 filed in Europe on Jun. 16, 2010, the entire content of which is hereby incorporated by reference in its entirety.

FIELD

The present disclosure relates to a Helmholtz damper and a method for regulating the resonance frequency of a Helmholtz damper. For example, the present disclosure relates to Helmholtz dampers to be connected to a lean premixed, low emission combustion systems of gas turbines.

BACKGROUND INFORMATION

Gas turbines can include one or more combustion chambers, wherein a fuel is injected, mixed to an air flow and combusted to generate high pressure flue gases that can be expanded in a turbine.

During operation pressure oscillations can be generated that may cause mechanical damage to the combustion chamber and limit the operating regime.

For at least this reason, combustion chambers can be equipped with damping devices, such as quarter wave tubes, Helmholtz dampers and acoustic screens, to damp these pressure oscillations.

With reference to FIG. 1, a known Helmholtz damper 1 can include an enclosure 2, that defines a resonator volume, and a neck 3 to be connected to a combustion chamber. Combustion and pressure oscillations can occur in the combustion chamber and can require damping. Reference 4 indicates the wall of the combustion chamber.

The resonance frequency (i.e., the damped frequency) of the Helmholtz damper can depend on the geometrical features of the resonator volume and neck and correspond to the frequency of the pressure oscillations generated in the combustion chamber.

The frequency of the pressure oscillations can slightly change from gas turbine to gas turbine and, in addition, also for the same gas turbine it can change during gas turbine operation. For example, at part load, base load, and transition.

At a low frequency range a damping frequency bandwidth of the Helmholtz dampers can be narrow, such that frequency shifting of pressure oscillations generated in a combustion chamber could render a Helmholtz damper connected to it and having a prefixed design resonance frequency, ineffective.

Thus, it can be beneficial to provide a Helmholtz dampers which allows tuning of the resonance frequency.

In order to tune the resonance frequency (to follow the frequency of the pressure oscillations generated in a combustion chamber), Helmholtz dampers have been developed having an adjustable volume.

WO2005/059441 discloses a Helmholtz damper having two cup-shaped tubular bodies mounted in a telescopic way.

EP1158247 discloses a Helmholtz damper whose resonance volume houses a flexible hollow element whose size may be changed by injecting or blowing off a gas. Changing the size of the flexible hollow element can allow the size of the resonance volume to be changed.

U.S. Patent Application Publication No. 2005/0103018 discloses a Helmholtz damper whose resonance volume is divided into a fixed and a variable damping volume. The variable volume may be regulated by an adjustable piston.

These arrangements can be demanding in terms of space for installation and of complex realisation.

Alternatively, tuning of the resonance frequency can be achieved by adjusting the neck of the Helmholtz dampers.

In this respect, EP0724684 discloses a Helmholtz damper in which the cross section of the neck may be adjusted.

EP1624251 discloses a Helmholtz damper with a neck whose length may be adjusted by overlapping a plate including holes to its mouth.

These arrangements are complex and, in addition, they do not allow a fine tuning of the resonance frequency to follow small shifting of the frequency pressure oscillations in the combustion chamber.

SUMMARY

A Helmholtz damper of the disclosure includes an enclosure; a neck extending from the enclosure; and a pipe for inserting into the neck.

A method is disclosed for regulating a resonance frequency of a Helmholtz damper including an enclosure and a neck extending from the enclosure, the method comprising providing a pipe for insertion into the neck; and adjusting a portion of the pipe inserted into the neck to regulate the resonance frequency of the Helmholtz damper.

BRIEF DESCRIPTION OF THE DRAWINGS

Further characteristics and advantages of the disclosure will be more apparent from the description of an exemplary but non-exclusive embodiments of a Helmholtz damper and method for regulating its resonance frequency illustrated by way of non-limiting examples in the accompanying drawings, in which.

DETAILED DESCRIPTION

Figure 1:
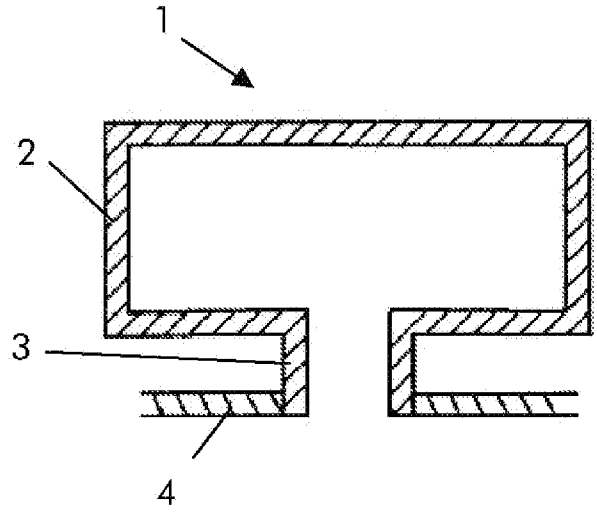
Fig. 1 PRIOR ART
FIG. 1 is a schematic view of a known Helmholtz damper.

Exemplary embodiments of the disclosure provide a Helmholtz damper and a method for regulating its resonance frequency.

According to exemplary embodiments, a Helmholtz damper and a method are disclosed which allow a fine tuning of the resonance frequency of the Helmholtz damper, which can have a simple structure and is substantially compact, and a Helmholtz damper with increased efficiency.

In an exemplary embodiment, the Helmholtz damper 1 includes an enclosure 2 from which a neck 3 extends. The neck 3 can be connected to a wall 4 of a combustion chamber.

A pipe 5 is partially inserted into and fits the neck 3. The pipe 5 is slidingly connected to the neck 3 and can be moved as indicated by arrows F. In addition, the pipe 5 is partially housed in the enclosure 2.

In an exemplary embodiment, an actuator can be provided, connected to the pipe 5 to adjust the portion inserted into the neck 3.

In an exemplary embodiment, the pipe 5 has a closed end 6, a perforated portion 7 that is housed within the enclosure 5 (the perforated portion has through holes that allow gas to pass through), and an open end 8 delimiting a continuous portion 9 whose surface is continuous in the sense that no perforations, through apertures or holes are provided in it. The continuous portion 9 can be at least partially inserted into the neck 3.

The actuator can include a knob 14 with a rod portion 15 passing through a through seat 16 of the enclosure 2. The rod portion 15 can be partially housed in the enclosure 2 and can be connected to the closed end 6 of the pipe 5, to allow the continuous portion 9 inserted into the neck 3 to be regulated (FIG. 2).

The Helmholtz damper 1 can include threaded drive portions 17 for the pipe 5 to allow a fine adjustment.

Figure 2:
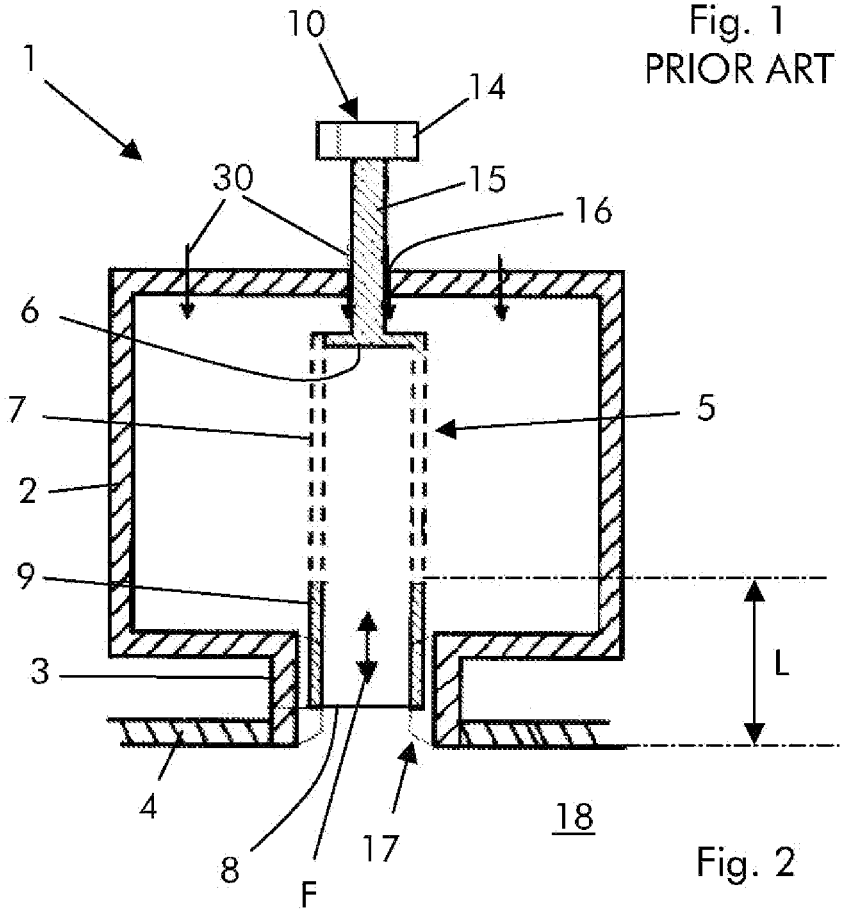
FIGS. 2 through 5 show Helmholtz dampers according to different exemplary embodiments of the disclosure.

The threaded drive portions 17 can be located at the outer surface of the continuous portion 9 of the pipe 5 and at the inner surface of the neck 3 (FIG. 2).

Figure 3:
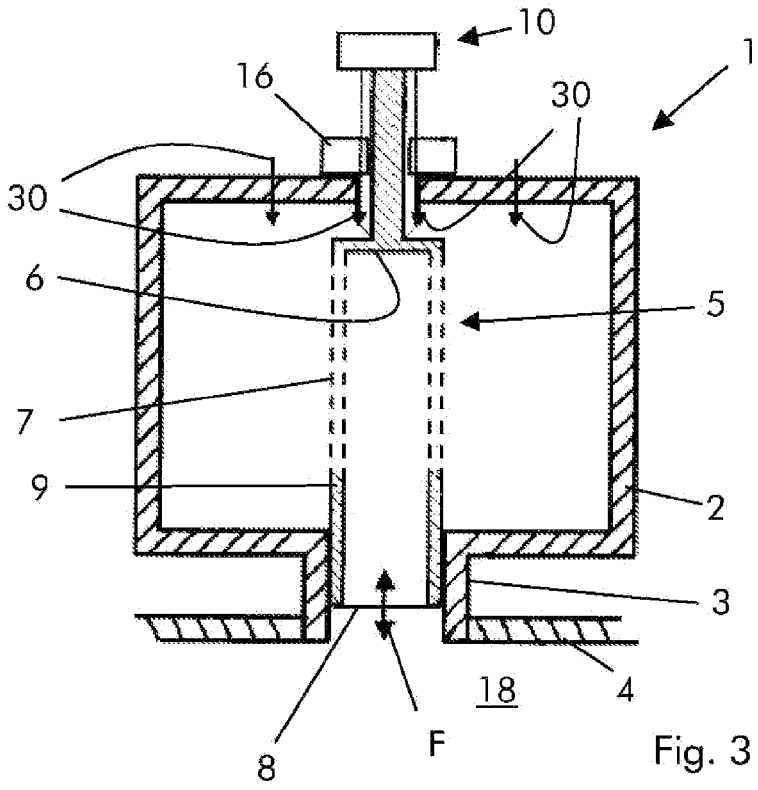

Alternatively, the threaded drive portions 17 can also be defined between the actuator 10 and the through seat 16. In this case a threaded nut may be provided as the seat 16 (FIG. 3).

The actuator 10 can be manually operated. In this case, once the gas turbine is activated and brought to operating regime, manual regulation is carried out.

Alternatively, or in addition to the manual regulation, the actuator 10 may also be automatically operated. In this case, sensors can be provided to detect pressure oscillations within the combustion chamber and connected to a control unit that drives the actuator 10. This automatic operation can allow continuous regulation of the Helmholtz damper over the operation of the gas turbine, to cope with different conditions that may be generated.

The operation of the Helmholtz damper of the disclosure is described and illustrated as follows.

During operation, in the inside of the combustion chamber (identified by reference 18) pressure oscillations can be generated.

These pressure oscillations can cause gas to oscillate in the conduit defined by the neck 3 and continuous portion 9 of the pipe 5 to provide damping. In FIG. 2, the length L of the conduit in which oscillations occur is shown.

In addition, further damping can be achieved via the perforated portion 7, through which the gas passes when oscillating in the neck 3.

Because the resonance frequency of the Helmholtz damper can depend on the geometrical features of the enclosure 2 and conduit (for example, it can depend on the length L of the conduit defined by the neck 3 and continuous portion 9 of the pipe 5), regulation of the length L of the conduit allows a fine tuning of the resonance frequency of the Helmholtz damper to follow small shifts of the frequency of the pressure oscillations in the combustion chamber.

In order to regulate the length L of the conduit, the part of the continuous portion 9 inserted into the neck 3 can be adjusted. In this respect, two exemplary modes of operation are disclosed.

In a first mode, at the beginning of the operation a part of the continuous portion 9 in the neck 3, (length L) can be regulated via the actuator 10. This configuration can be maintained over the operation, because typically if operating conditions do not change, the frequency of the pressure oscillations does not change.

In a second mode, the actuator 10 can continuously automatically control the part of the continuous portion 9 inserted into the neck 3 (and thus the length L) over the operation of the gas turbine.

In both modes, the part of the continuous portion 9 in the neck 3 (and thus the length L) may be regulated between a position in which the whole continuous portion 9 is within the neck 3 (so that the length L of the conduit is equal to the length of the neck 3) and a position with the portion 9 partially outside of the neck 3. In the latter case the length L of the conduit is the sum of the length of the neck 3 and the part of the continuous portion 9 outside of the neck 3.

The perforated portion 7 can allow the damping properties of the Helmholtz damper to be increased and can render the damping bandwidth larger.

In addition, cooling holes may be provided in the enclosure 2 for the entrance of cooling air 30. Cooling air 30 can also enter the enclosure 2 via the through seat 16.

Figure 4:
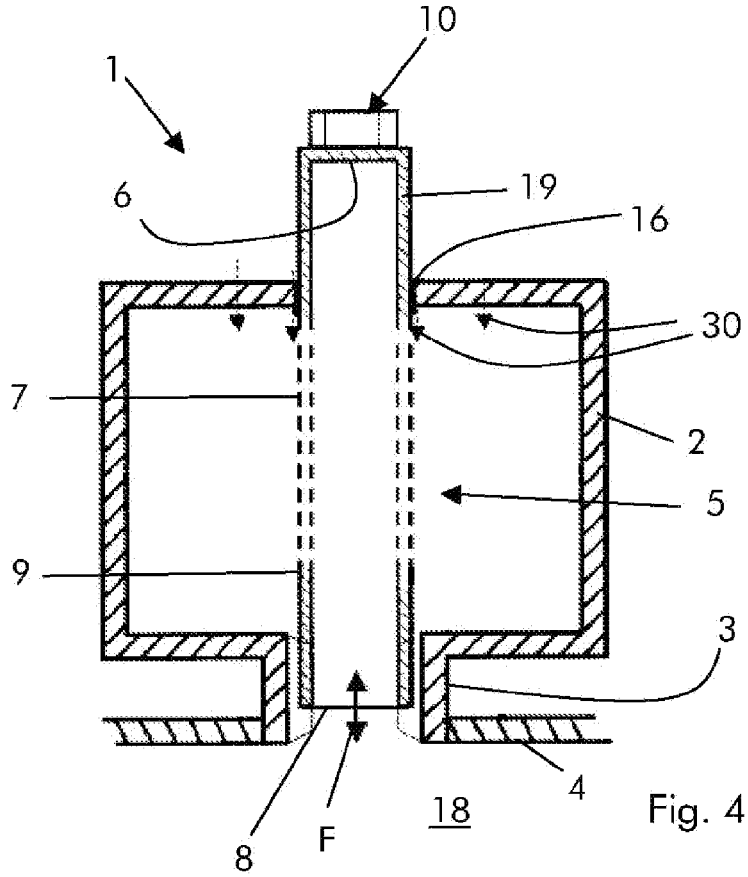

In an exemplary embodiment shown in FIG. 4, the enclosure 2 has a through seat 16, which can be located in a position opposite to the neck 3 and the pipe 5 extends outside of the enclosure 2 through the seat 16.

In this exemplary embodiment, the pipe 5 has a second continuous portion 19 delimited by the closed end 6 and extending outside of the enclosure 2.

In addition, the actuator 10 is connected to the top of the pipe 5 and is, for example, a nut manually operable or an automatic actuator.

The other features and the operation of the Helmholtz damper in this exemplary embodiment are similar to those already described with reference to the embodiments of FIGS. 2 and 3.

In addition, the pipe 5 can also operate as a wave quarter tube and increase the damping frequency bandwidth of the Helmholtz damper.

Figure 5:
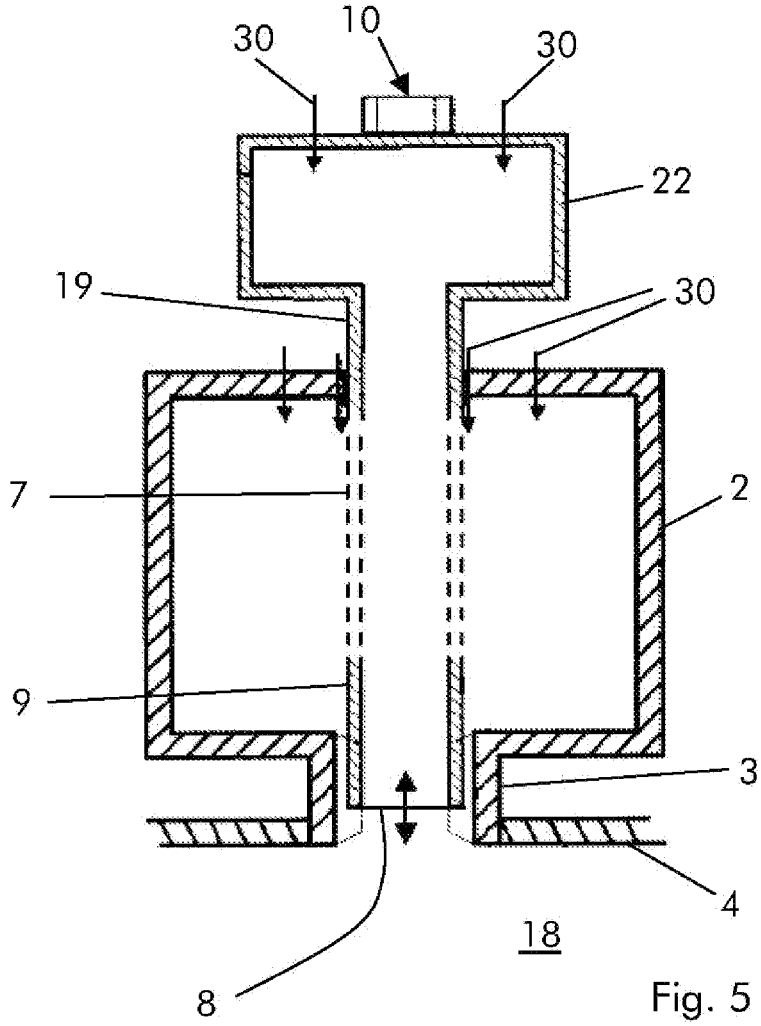

In an exemplary embodiment shown in FIG. 5, the closed end of the pipe 5 can be defined by an enlarged casing 22, which can be placed outside of the enclosure 2, and connected to the second continuous portion 19.

Cooling holes can also be provided in the enlarged casing 22 such that cooling air 30 also enter thereinto (in addition or instead of the enclosure 2).

The features and the operation are similar to those already described with reference to the embodiments of FIGS. 2 and 3. In addition, the damping frequency bandwidth can be larger than that of the Helmholtz damper shown in FIGS. 2 and 3, because the casing 22 operates like a second Helmholtz damper connected in series to the first Helmholtz damper constituted by the enclosure 2 with neck 3.

The present disclosure also relates to a method for regulating the resonance frequency of the Helmholtz damper 1.

The method includes regulating, via the actuator 10, the portion (i.e., its length) of the pipe 5 inserted into the neck 3.

In practice, the materials used and the dimensions can be chosen at will from among those already available, and according to specifications and to the state of the art.

It will be appreciated by those skilled in the art that the present invention embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE NUMBERS

1 Helmholtz damper
2 enclosure
3 neck
4 wall of the combustion chamber
5 pipe
6 closed end of 5
7 perforated portion of 5

8 open end of 5
9 continuous portion of 5
10 actuator
14 knob of 10
15 rod portion of 10
16 through seat
17 threaded drive portions
18 inside of the combustion chamber
19 second continuous portion
22 enlarged casing
30 cooling air
F movement of 5
L length of the conduit defined by 3 and 9

What is claimed is:

1. A Helmholtz damper comprising:

an enclosure having a fixed volume including a resonating chamber;

a neck extending from the enclosure; and a pipe for inserting into the neck;

wherein the pipe has a perforated portion including at least three through holes for damping by allowing gas to pass through to the resonator chamber, the pipe being housed within the enclosure and includes an open end delimiting a continuous portion that is at least partially inserted into the neck, and the perforated portion of the pipe is located entirely outside of the neck.

2. The Helmholtz damper as claimed in claim 1, comprising:

an actuator for changing a length of the pipe that is inserted into the neck.

3. The Helmholtz damper as claimed in claim 1, wherein the pipe has a closed end opposite the open end.

4. The Helmholtz damper as claimed in claim 3, wherein the enclosure has a through seat and the actuator extends from an inside to an outside of the enclosure through the through seat.

5. The Helmholtz damper as claimed in claim 4, wherein the through seat is in a position opposite the neck.

6. The Helmholtz damper as claimed in claim 4, wherein the pipe has a second continuous portion delimited by the closed end and extending outside of the enclosure.

7. The Helmholtz damper as claimed in claim 6, wherein the closed end of the pipe is defined by a casing enlarged relative to other portions of the pipe and extending from the second continuous portion.

8. The Helmholtz damper as claimed in claim 7, wherein the casing is outside of the enclosure.

9. The Helmholtz damper as claimed in claim 1, comprising:

threaded drive portions for actuating the pipe.

10. The Helmholtz damper as claimed in claim 9, wherein the threaded drive portions are located at a continuous portion of the pipe and at the neck extending from the enclosure.

11. The Helmholtz damper as claimed in claim 2, wherein the actuator comprises:

a rotatable knob with a rod portion connected to the pipe, wherein the rod portion is partially housed in a through seat of the enclosure and is partially housed in the enclosure.

12. The Helmholtz damper as claimed in claim 11, wherein threaded drive portions are defined between the actuator and the through seat.

13. The Helmholtz damper as claimed in claim 2, wherein the actuator is manually or automatically operated.

14. A method for regulating a resonance frequency of a Helmholtz damper including an enclosure having a fixed volume with a resonator chamber and a neck extending from the enclosure, the method comprising:

providing a pipe for insertion into the neck;

adjusting a portion of the pipe inserted into the neck to regulate the resonance frequency of the Helmholtz damper, wherein the pipe has a perforated portion including at least three through holes for damping by allowing gas to pass through to the resonator chamber, the pipe being housed within the enclosure and having an open end delimiting a continuous portion that is at least partially inserted into the neck, and wherein the perforated portion of the pipe is located entirely outside of the neck.

15. The method as claimed in claim 14, wherein the pipe has a closed end opposite the open end.

16. The method as claimed in claim 14, wherein the enclosure has a through seat and an actuator performs the adjusting, and extends from an inside to an outside of the enclosure through the through seat.

17. The method as claimed in claim 15, wherein the pipe has a second continuous portion delimited by the closed end and extending outside of the enclosure.

18. The method as claimed in claim 17, wherein the closed end of the pipe is defined by a casing enlarged relative to other portions of the pipe and extending from the second continuous portion.

* * * * *